United States Patent [19]

Brown et al.

[11] Patent Number: 4,911,179

[45] Date of Patent: Mar. 27, 1990

[54] PATIENT RESTRAINING DEVICE FOR USE IN PHYSIOTHERAPY

[75] Inventors: Steven D. R. Brown; Jacqueline Thatcher, both of Derby; Irfan H. Bhatti, Macclesfield; Heath S. Teasdale, Surrey; John M. Rhodes, Stafford, all of England

[73] Assignee: Rolls-Royce plc, London, United Kingdom

[21] Appl. No.: 193,554

[22] Filed: May 13, 1988

[30] Foreign Application Priority Data

May 28, 1987 [GB] United Kingdom ..... 8712498

[51] Int. Cl.[4] ..... A61F 13/00

[52] U.S. Cl. ..... 128/846; 128/875; 128/876

[58] Field of Search ..... 128/869, 870, 871, 875, 128/876, 846, 84 C; 5/444, 80; 219/322, 326

[56] References Cited

U.S. PATENT DOCUMENTS

| | | | |
|---|---|---|---|
| 590,625 | 9/1897 | Paquette | 128/85 |
| 1,242,688 | 10/1917 | Hawley | 128/84 C |
| 2,230,620 | 2/1941 | Leiter | 128/84 C |
| 2,853,999 | 9/1958 | Risser | 128/84 C |
| 3,477,428 | 11/1969 | Hare | 128/85 |
| 4,122,587 | 10/1978 | Weiss | 128/870 |
| 4,328,794 | 5/1982 | Holmes | 128/85 |
| 4,417,572 | 11/1983 | Green | 128/869 |

FOREIGN PATENT DOCUMENTS

| | | |
|---|---|---|
| 00154 | 7/1985 | PCT Int'l Appl. . |
| 817529 | 7/1959 | United Kingdom . |
| 862277 | 3/1961 | United Kingdom . |
| 1188467 | 4/1970 | United Kingdom . |
| 1241894 | 8/1971 | United Kingdom . |

*Primary Examiner*—Robert A. Hafer
*Assistant Examiner*—Michael Brown
*Attorney, Agent, or Firm*—Cushman, Darby & Cushman

[57] ABSTRACT

A patient restraining device suitable for use in physiotherapy comprises a framework which in use is located at the foot of a bed. A roller is rotatably mounted on the framework, and a belt is secured to and wound around the roller. A harness is secured to the free end of the belt, and the harness is provided with cushioned straps. A length of belt is unwound from the roller to suit the particular patient, and the roller is locked in this position by a ratchet wheel and pawl spindle. The patient lies on the bed over the harness and belt so that the patients feet are adjacent the framework and the cushioned straps are wrapped around the patients legs to hold the patient. The patient restraining device allows a single physiotherapist to perform physiotherapy while the patient is prevented from moving away from the framework.

24 Claims, 6 Drawing Sheets

PATIENT RESTRAINING DEVICE FOR USE IN PHYSIOTHERAPY

The present invention relates to a patient restraining device for use in physiotherapy.

At present patients suffering from spinal problems receive traction physiotherapy. This requires the presence of two physiotherapists; one physiotherapist performs the physiotherapy exercises on the patient's neck and spine while the other physiotherapist grips the legs of the patient, to ensure that the patient remains stationary while the physiotherapy is being performed.

This procedure is wasteful of the time of skilled physiotherapists.

The present invention seeks to provide a patient restraining device which will maintain a patient stationary for physiotherapy.

Accordingly the present invention provides a patient restraining device for use in physiotherapy comprising a framework locatable on one end of a bed structure for the transmission of loads into the bed structure, harness means for holding the patient being mounted from and being adjustably movable relative to the framework, locking means to selectively lock the harness means so that the harness means and any patient held thereby during physiotherapy cannot be moved in directions away from the framework.

The harness means may be adjustably movable relative to the framework by winding means rotatably mounted on the framework.

The winding means may comprise a roller.

At least one belt may be attached by a first end to the roller, the at least one belt being attached to the harness means at a second end of the belt.

The at least one belt may be formed from material having substantially no elasticity.

The at least one belt may be formed from cotton polymer material.

The at least one belt may be formed from said cloth material.

The harness means may comprise a base plate, the base plate having a cushioned overlay.

The harness means may comprise at least one strap for holding the patient.

The at least one strap may be formed from a material having substantially no elasticity.

The at least one strap may be formed from cotton polymer material.

The at least one strap may be formed from sail cloth material.

The at least one strap may have a cushioned lining.

The roller may have at least one spring, the spring acting on the roller so as to wind the harness means towards the roller.

The at least one spring may be a torsion spring.

The locking means may comprise a ratchet wheel mounted on the roller, a pawl spindle mounted coaxially in a bore formed in the framework, the pawl spindle being movable axially of the bore between a first position in which the pawl spindle is engaged with the ratchet wheel to prevent rotation of the roller, and a second position in which the pawl spindle is disengaged from the ratchet wheel to allow rotation of the roller.

The pawl spindle may be biased to the second position by a spring.

The pawl spindle may have a flange, the spring being positioned coaxially of the bore around the pawl spindle and acting on the flange.

The pawl spindle is rotatable through 90° while in the first position between a locked position in which axial movement of the pawl spindle to the second position is prevented and an unlocked position in which the pawl spindle is free to move axially to the second position under action of the spring.

The spindle may have a portion having two mutually parallel flat faces, the bore having a portion of rectangular cross-section which has two mutually parallel flat faces, in the locked position the parallel flat faces of the pawl spindle are perpendicular to the parallel flat faces of the bore, in the unlocked position the parallel flat faces of the pawl spindle are aligned to the parallel flat faces of the bore.

The pawl spindle may have two projections extending radially therefrom 180° apart at the same axial location, a portion of the bore having two recesses 180° apart at the same axial location, in the locked position the projections are arranged perpendicular to the recesses of the bore, in the unlocked position the projections are aligned with the bore.

The mutually parallel flat faces of the portion of the bore may be formed in a locking member, the locking member being removably threaded into the bore.

The recesses in the portion of the bore may be formed in a locking member, the locking member being removably threaded into the bore.

The framework may be removably locatable on the bed structure.

The framework may comprise two spaced end members, a transverse member extending between and secured to the end members, the transverse member abutting and transmitting loads to the bed structure.

The ends of the roller may be rotatably mounted in the end members.

The framework may comprise parallel cross members secured to the end members, the cross members having parallel slots which enable the framework to slidably engage a corresponding structure of the bed structure.

The transverse member may have first and second spaced members which have flanges to abut and transmit loads into the bed structure.

The first and second spaced members may have portions extending substantially perpendicular to the flanges, an adjustable belt being secured at one end to the portion of the first member and secured at the other end to the portion of the second member, the belt being arranged to extend transversely such that the belt removably grips the bed structure.

The present invention will be more fully described by way of example with reference to the accompanying drawings, in which.

Figure 1:
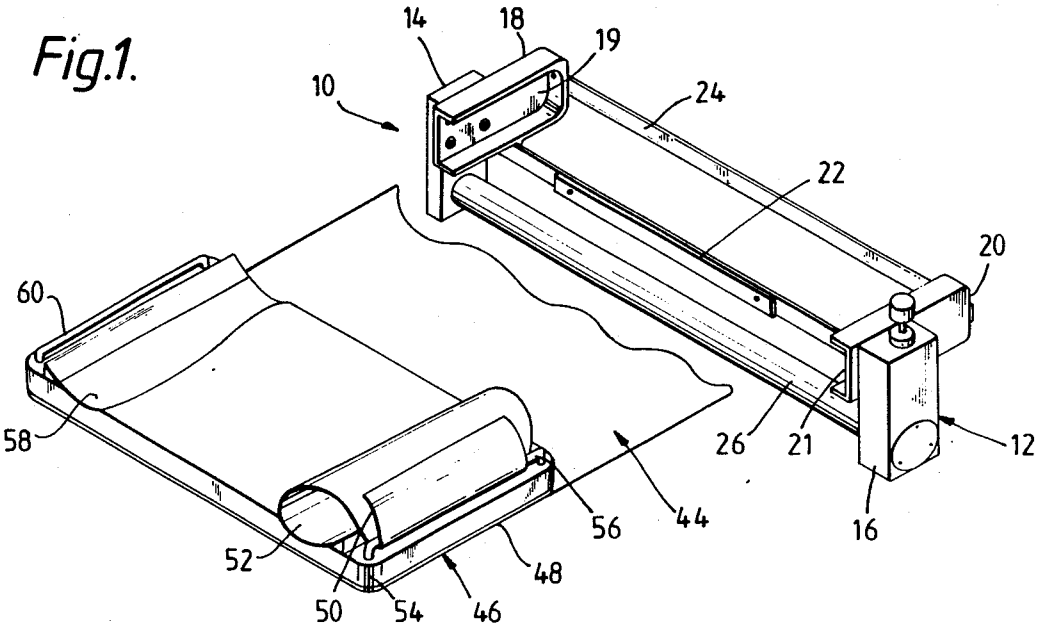
FIG. 1 is a perspective view of a patient restraining device for use in physiotherapy according to the present invention.

A patient restraining device 10 suitable for use in physiotherapy is shown in FIGS. 1 to 5. The patient restraining device 10 comprises a framework 12, a harness 46 and a belt 44.

The framework 12 is removably located or secured to one end of a physiotherapy bed in operation, although the framework can be adapted to be removably located on ordinary hospital beds. The framework 12 comprises two spaced apart end members 14 and 16, which are substantially vertical when the framework 12 is positioned on the end of the bed, and two cross members 18 and 20, which are arranged substantially at 90° to the end members 14 and 16, and are secured to the end members 14 and 16 respectively by bolts and threaded apertures, by nuts and bolts or any suitable securing means. A transverse member 22 extends between and is secured to the cross members 18 and 20 by any suitable securing means, although the transverse member 22 could equally well extend between and be secured to the end members 14 and 16. A second transverse member 24 extends between and is secured to the cross members 18 and 20.

Figure 2:
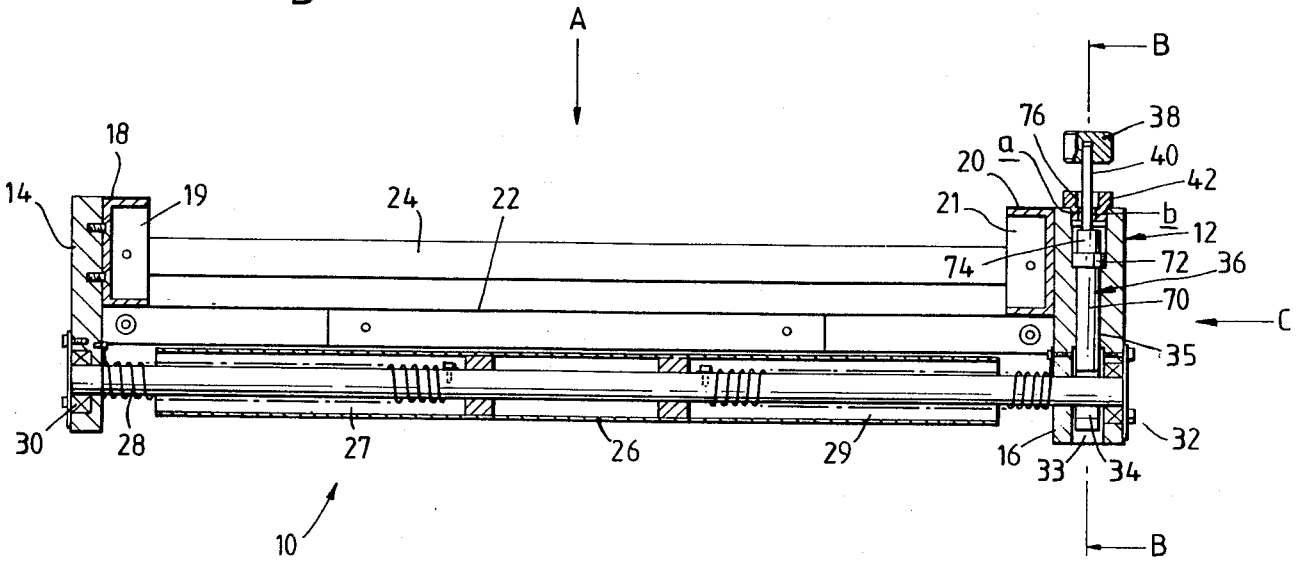
FIG. 2 is a vertical section through a framework of the patient restraining device shown in FIG. 1.
Figure 3:
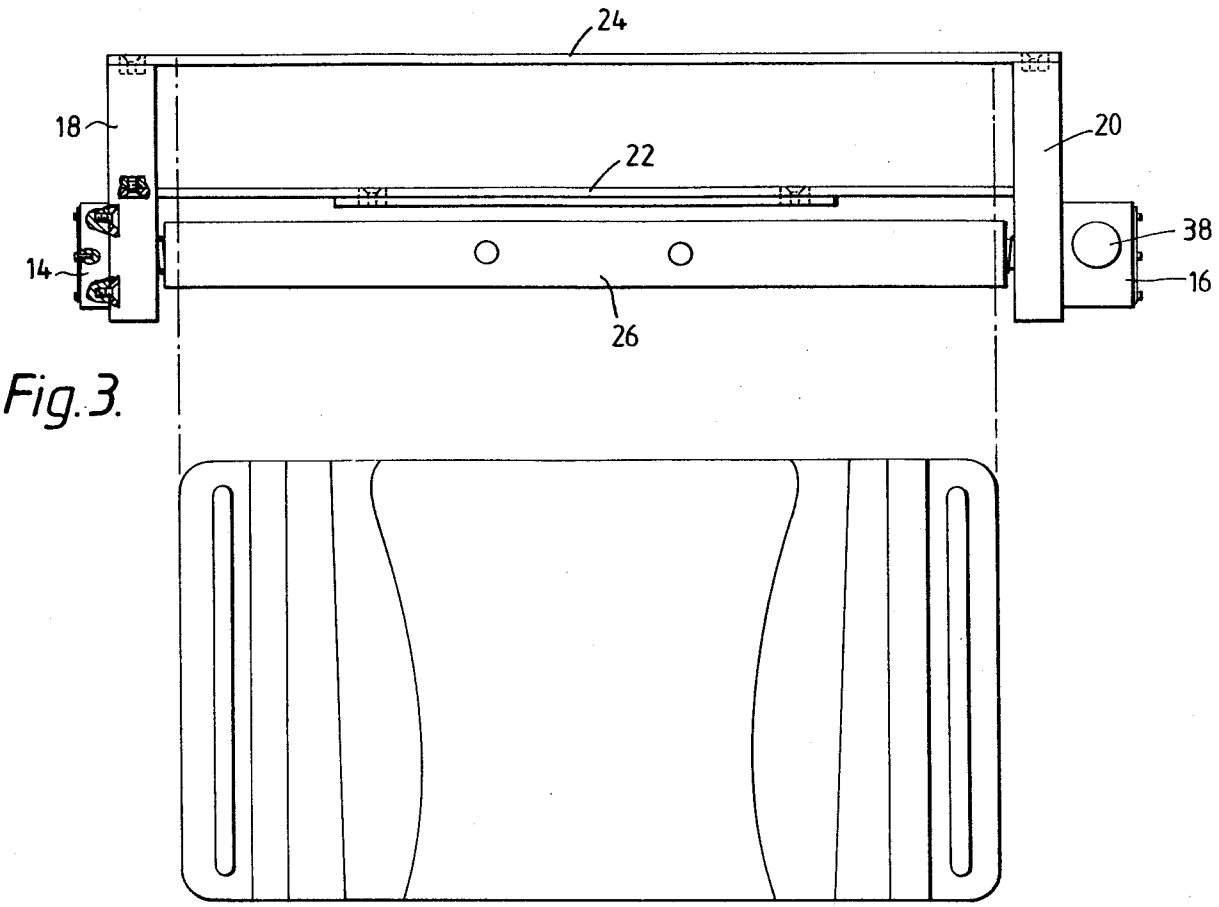
FIG. 3 is a view in the direction of arrow A in FIG. 2.

A roller 26 extends between and is rotatably mounted in the end members 14 and 16 by bearings 30 and 32 (FIG. 2). The roller 26 has a shaft 28 and a pair of torsion springs 27 and 29 are positioned coaxially with the shaft 28. A ratchet 34 is provided at one end of the shaft 28, within a chamber 33 in the end member 16.

Figure 4:
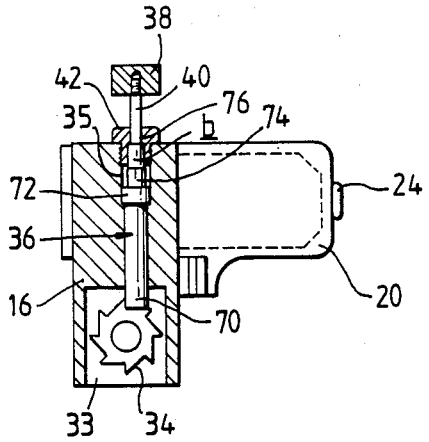
FIG. 4 is a cross-section along line B—B in FIG. 2.
Figure 5:
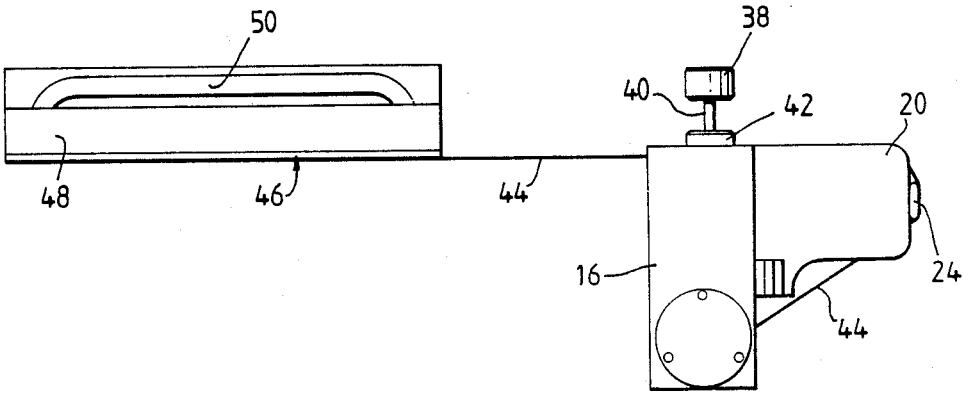
FIG. 5 is a view in the direction of arrow C in FIG. 2.
Figure 6:
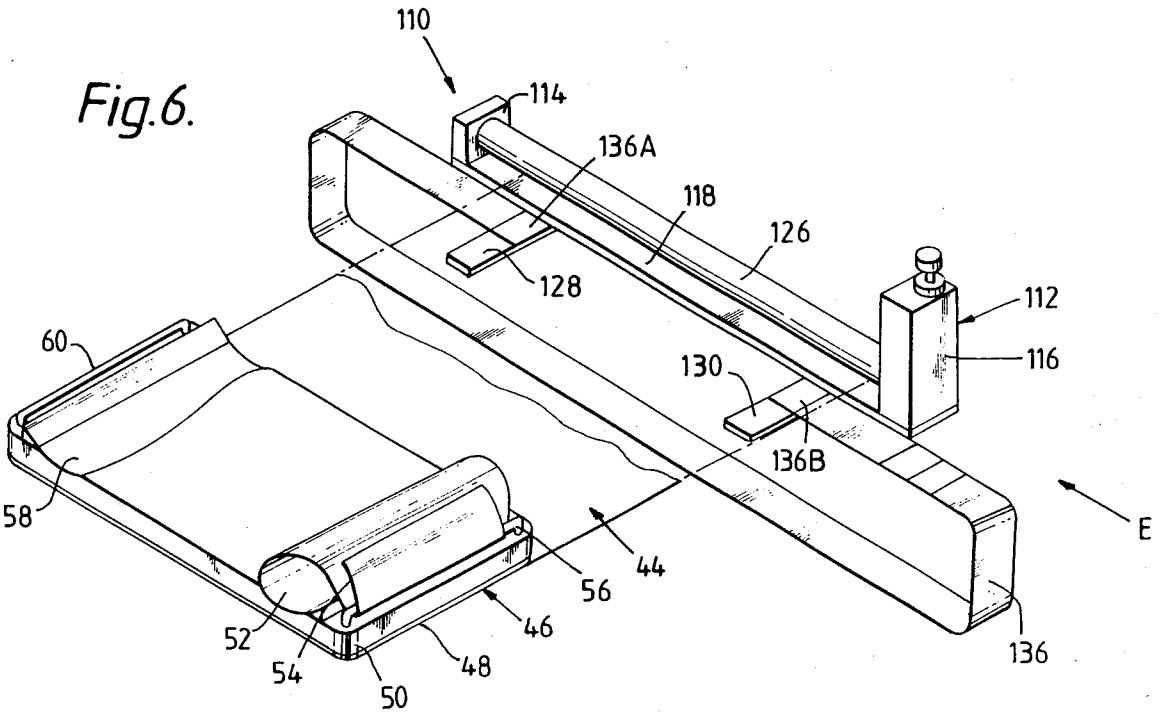
FIG. 6 is a perspective view of another patient restraining device for use in physiotherapy according to the present invention.

A pawl spindle 36 extends through a vertical bore 35 in the end member 16 to engage the ratchet wheel 34 as shown best in FIG. 4. The pawl spindle 36 has a lower portion 70 having a first diameter which is a sliding fit in a corresponding lower portion of bore 35; an annular flange 72 having a second, larger, diameter which is a sliding fit in a corresponding upper portion of bore 35; a mid-portion 74 having a third, smaller diameter upon the upper end of which are milled two mutually parallel flat faces a and b; and an upper portion 40 having a fourth, yet smaller diameter, onto which is fixed a knurled knob 38.

In order to provide a means of engaging and disengaging the pawl spindle 36 and the ratchet wheel 34, the pawl spindle passes through and engages a locking collar 42 which is screwed into the end of the upper portion of bore 35. This locking collar is provided with a stepped bore 76 whose lower portion is large enough to accept the full diameter of the mid-portion 74 of the pawl spindle 36. However, the upper portion of the bore is rectangular in plan, having flat faces corresponding to the two flat faces a and b on the pawl spindle 36. In the position shown, the flat faces a and b on the pawl spindle are set at right angles to the corresponding faces in the bore 76 and consequently the pawl spindle is held engaged with the ratchet wheel 34. To disengage the ratchet, the knob 38 is rotated through a right angle so that faces a and b on the paw spindle 36 are aligned with the corresponding faces in the bore 76. Thereupon, the pawl spindle 36 is spring-urged out of engagement with the ratchet wheel 34 by means of a spring (not visible in the drawing, but which in the illustrated position is held compressed between the underside of the annular flange 72 and the step in the bore 35), so that the portion of the pawl spindle provided with the flat faces a and b slides up through the upper portion of bore 76.

The cross members 18 an 20 are provided with slots 19 and 21 respectively (FIGS. 1 and 2) which enable the framework 12 to be removably slid onto corresponding structure of the bed, and the transverse member 22 locates by abutting against the structure of the bed. The transverse member 22 in abutting against the structure of the bed allows the strain, pressure or shock loading applied by the physiotherapist to be transmitted into the structure of the bed.

The belt 44 is attached at one end to the roller 26 and is attached at the other end to the harness 46. The belt 44 passes around and over the transverse member 24 (see FIG. 5), which is rounded to prevent wear, and then passes between the end members 14 and 16. The belt is a cotton polymer, sail cloth or any other suitable material which preferably has little or no elasticity.

The harness 46 comprises a base plate 48 of aluminium, or other suitable material and a foam overlay 50. A pair of broad straps 52 and 58 (FIG. 1) are provided to hold the legs of a patient, the straps being formed of cotton polymer or other suitable material lined with foam. The ends of the straps 52 and 58 are passed under bars 56 and 60 and fastened to the remainder of the straps by fastenings 54, for example "Velcro" (Registered Trade Mark), to give a firmer fastening of the legs to the harness 46.

The framework is constructed of any suitable material for example aluminium, and parts subject to wear are constructed of stainless steel i.e. the bearings, ratchet and pawl spindle.

In operation the framework 12 is located onto one end, i.e. the foot, of the physiotherapy bed, and the knob 38 is then rotated to allow the parallel faces a and b on the spindle 36 to align with the faces in the locking collar 42. The spindle 36 moves axially in the bore 35 under the action of the spring and disengages from the ratchet 34, and allows the harness 46 and belt 44 to be moved along the bed against the force of the torsion springs. The roller 36 allows the positioning of the harness 46 to be varied according to the height of the patient. When the correct length of belt 44 has been unwound from the roller 26, the knob 38 is turned through 90° to push the spindle 36 back into engagement with the ratchet 34 and prevent the belt being wound back onto the roller 26. The patient is then positioned on the bed with feet adjacent the framework 12 and legs overlying the belt 44 and harness 46. Straps 52 and 58 are secured around the legs of the patient and pulled firmly tight using the bars 56 and 60 and then secured with the fasteners 54.

The physiotherapist can then perform exercises on the neck and spine of the patient at the opposite end of the bed i.e. the head of the bed while the patient is held stationary on the bed by the patient restraining device 10, which substantially prevents the patient from being pulled away from the framework 12 which is located at the foot end of the bed.

The harness 46 and belt 44 are retractable back to the framework 12 after the physiotherapy is complete by simply turning the knob 38 through 90°. This disengages the spindle 36 from the ratchet 3 and the torsion springs 27 and 29 automatically rotate the roller 26 and wind the belt 44 onto the roller 26. The patient restraining device can then be removed from the bed and stored away.

This patient restraining device allows a single physiotherapist to perform physiotherapy while the patient is held stationary on the bed. The patient restraining device is adjustable to allow use with all heights of patients. The patient restraining device is easy and quick to operate for a single person, is relatively inexpensive and is compact and lightweight for easy storage when not in use.

Another patient restraining device 110 suitable for use in physiotherapy is shown in FIGS. 6 to 9. The patient restraining device comprises a framework 112, a harness 46 and a belt 444.

The framework 112 is also removably located or secured to one nd of a physiotherapy bed in operation, although this framework is adapted to be removably located on ordinary hospital beds. The framework 112 comprises two space end members 114 and 116, which are substantially vertical when the framework 112 is positioned on the end of the bed, and a transverse member 118 extends between and is secured to the end members 114 and 116.

A roller 126 extends between and is rotatably mounted in the end members 114 and 116 by bearings. The roller 126 also comprises a shaft and a pair of torsion springs positioned coaxially with the shaft. A ratchet 134 is provided at one end of the shaft, within a chamber 133 formed in the end member 116.

Figure 7:
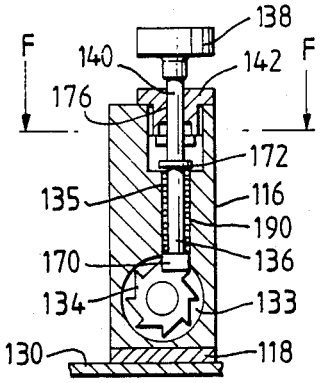
FIG. 7 is a vertical cross-section along line D—D in FIG. 6.
Figure 8:
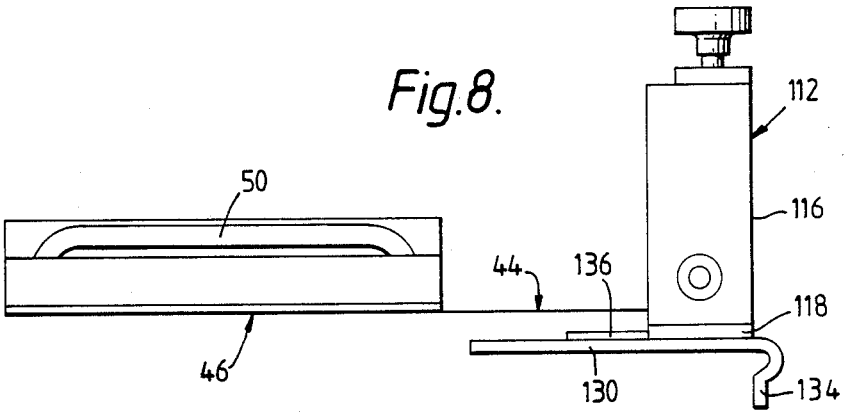
FIG. 8 is a view in the direction of arrow E in FIG. 6.
Figure 9:
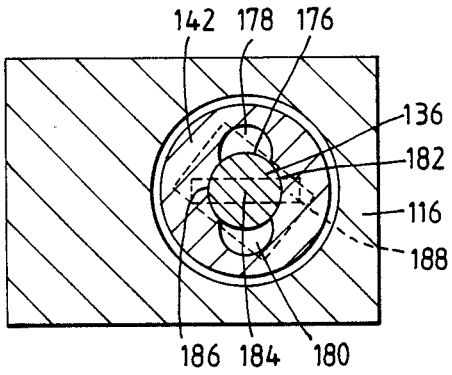
FIG. 9 is a horizontal sectional view to an enlarged scale along line F—F.

A pawl spindle 136 extends through a vertical bore 135 in the end member 116 to engage the ratchet wheel 134 as seen in FIG. 7. The pawl spindle 136 has a lower portion 170 having a first diameter which is a sliding fit in a corresponding lower portion of bore 135. The remainder of the pawl spindle 136 is of a second, smaller, diameter, except for an annular flange 172 having a larger diameter. The upper portion 140 of the pawl spindle 136 has a knurled knob 138 secured thereto.

A locking collar 142 is screwed into the end of an upper portion of the bore 135. The locking collar 142 has a bore 176 whose diameter corresponds to the diameter of the pawl spindle 136. The lower portion of the bore 176 has two recesses 178 and 180 spaced circumferentially 180° degrees apart.

The pawl spindle 136 has an aperture 182 which extends radially therethrough, a rod 184 is located in the aperture 182 and the ends of the rod 184 form projections 186,188 from the open ends of the aperture 182. The pawl spindle could equally well be formed integrally with two projections extending radially therefrom spaced circumferentially by 180°.

A spring 190 is also provided in the bore 135 to urge the pawl spindle 136 out of engagement with the ratchet wheel 134.

The pawl spindle 136 is arranged so that the projections 186 and 188 are at right angles to the recesses 178 and 180 in the bore 176 of the locking collar 142 to hold the pawl spindle 136 in engagement with the ratchet wheel 134. The pawl spindle 136 is rotated through 90° so that the projections 186 and 188 align with the recesses 178 and 180 in the bore 176, and the pawl spindle 136 is then spring urged out of engagement with the ratchet wheel 134.

The transverse member 118 of the framework 112 is provided with first and second members 128 and 130 which are spaced apart lengthwise of the transverse member 118, and which have flanges 132 and 134 which in operation locate and abut against the structure of the bed. The flanges 132 and 134 in abutting against the structure of the bed allows shock loading applied by the physiotherapist to be transmitted into the structure of the bed.

A belt 136 has a first end 136A which is secured to the first member 128, and a second end 136B which is secured to the second member 130. The belt 136 extends transversely from the first member 128 to the second member 130, but in use the belt 136 extends transversely of the bed structure to grip the bed structure to further locate the framework 112 on the bed structure. The belt 136 is adjustable to vary the grip on the bed structure, and to allow the framework 112 to b removed from the bed structure.

The patient restraining device 110 is used in substantially the same manner as that in FIGS. 1 to 6 and its operation will not be repeated.

We claim:

1. A patient restraining device for use in physiotherapy comprising a framework locatable on one end of a bed structure for the transmission of loads into the bed structure, a harness for holding the patient being mounted from and being adjustably movable relative to the framework, a roller rotatably mounted on the framework, the harness being adjustably movable relative to the framework by the roller, a locking means to selectively lock the harness so that the harness and any patient held thereby during physiotherapy cannot be moved in directions away from the framework, the locking means comprising a ratchet wheel mounted on the roller, the framework having a bore formed therein, a pawl spindle being mounted coaxially in the bore in the framework, a spring being mounted coaxially in the bore around the pawl spindle, the pawl spindle has a flange, the pawl spindle being movable axially of the bore from a first position in which the pawl spindle engages the ratchet wheel to a second position in which the pawl spindle disengages the ratchet wheel to allow rotation of the roller, the spring acting on the flange of the pawl spindle to bias the pawl spindle to the second position, the pawl spindle being rotatable through 90° while in the first position between a locked position in which axial movement of the pawl spindle to the second position is prevented and an unlocked position in which the pawl spindle is free to move axially to the second position under action of the spring.

2. A patient restraining device as claimed in claim 1 in which the pawl spindle has two projections extending radially therefrom 180° apart at the same axial location, a portion of the bore having two recesses 180° apart at the same axial location, in the locked position the projections are arranged perpendicular to the recesses of the bore, in the unlocked position the projections are aligned with the recesses in the bore.

3. A patient restraining device as claimed in claim 2 in which the recesses in the portion of the bore are formed in a locking member, the locking member being removably threaded into the bore.

4. A patient restraining device as claimed in claim 1 in which the pawl spindle has a portion having two mutually parallel flat faces, the bore having a portion of rectangular cross-section which has two mutually parallel flat faces, in the locked position the parallel flat faces of the portion of the pawl spindle are perpendicular to the parallel flat faces of the bore, in the unlocked position the parallel flat faces of the pawl spindle are aligned to the parallel flat faces of the bore.

5. A patient restraining device as claimed in claim 4 in which the mutually parallel flat faces of the portion of the bore are formed in a locking member, the locking member being removably threaded into the bore.

6. A patient restraining device for use in physiotherapy comprising a framework locatable on one end of a bed structure for the transmission of loads into the bed structure, a harness for holding the patient being mounted from and being adjustably movable relative to the framework, the harness comprising a base plate and at least one strap, the base plate having a cushioned overlay, the at least one strap being secured at one end to the base plate and being arranged to hold the patient, a locking means to selectively lock the harness so that the harness and any patient held thereby during physiotherapy cannot be moved in directions away from the framework.

7. A patient restraining device as claimed in claim 6 in which the at least one strap is formed from a material having substantially no elasticity.

8. A patient restraining device as claimed in claim 7 in which the at least one strap is formed from cotton polymer material.

9. A patient restraining device as claimed in claim 7 in which the at least one strap is formed from sail cloth material.

10. A patient restraining device as claimed in claim 6 in which the at least one strap has a cushioned lining.

11. A patient restraining device as claimed in claim 6 in which the framework is removably locatable on the bed structure.

12. A patient restraining device as claimed in claim 6 in which a roller is rotatably mounted on the framework, the harness being adjustably movable relative to the framework by the roller, at least one belt having a first end and a second end, the at least one belt being attached by the first end to the roller, the at least one belt being attached by the second end to the harness.

13. A patient restraining device as claimed in claim 12 in which the at least one belt is formed from material having substantially no elasticity.

14. A patient restraining device as claimed in claim 13 in which the at least one belt is formed from cotton polymer material.

15. A patient restraining device as claimed in claim 13 in which the at least one belt is formed from sail cloth material.

16. A patient restraining device as claimed in claim 12 in which the roller has at least one spring, the spring acting on the roller so as to wind the harness towards the roller when the locking means is released from locking the harness means.

17. A patient restraining device as claimed in claim 16 in which the at least one spring is a torsion spring.

18. A patient restraining device as claimed in claim 12 in which the harness comprises a first strap arranged to hold a first leg of the patient and a second strap arranged to hold a second leg of the patient.

19. A patient restraining device as claimed in claim 18 in which the harness comprises a first bar secured to the base plate and a second bar secured to the base plate, the first bar and the second bar being arranged to extend in a direction parallel to the length of the belt, the first strap being arranged to pass around the first bar to hold the first leg of the patient and the second strap being arranged to pass around the second bar to hold the second leg of the patient.

20. A patient restraining device as claimed in claim 6 in which the framework comprises two spaced end members, a transverse member extending between and secured to the end members, the transverse member abutting and transmitting loads to the bed structure.

21. A patient restraining device as claimed in claim 20 in which the roller has ends, the ends of the roller being rotatably mounted in the end members.

22. A patient restraining device as claimed in claim 20 in which the framework comprises parallel cross members secured to the end members, the cross members having parallel slots which enable the framework to slidably engage a corresponding structure of the bed structure.

23. A patient restraining device as claimed in claim 20 in which the transverse member has first and second spaced members the first and second members have flanges to abut and transmit loads into the bed structure.

24. A patient restraining device as claimed in claim 23 in which the first and second spaced members have portions extending substantially perpendicular to the flanges, an adjustable belt having ends, the adjustable belt being secured at one end to the portion of the first member and secured at the other end to the portion of the second member, the belt being arranged to extend transversely such that the belt removably grips the bed structure.

* * * * *